United States Patent [19]

Pocock et al.

[11] Patent Number: 4,606,476

[45] Date of Patent: Aug. 19, 1986

[54] SYSTEM FOR SANITIZING BEVERAGE DISPENSING SYSTEMS

[76] Inventors: Richard L. Pocock, 88 Stockbridge Rd., Scituate, Mass. 02066; Kevin M. Looney, 27 Old Billerica Rd., Bedford, Mass. 01730

[21] Appl. No.: 745,599

[22] Filed: Jun. 17, 1985

[51] Int. Cl.[4] ..... B67D 1/08; B08B 3/00

[52] U.S. Cl. ..... 222/148; 222/135; 222/255; 222/265; 222/330; 134/169 R; 137/240; 141/1; 141/89; 141/351

[58] Field of Search ..... 222/129.1, 1, 148, 207, 222/252, 255, 265, 330, 331, 372, 135, 136; 141/85, 89, 90, 91, 1, 382, 383, 384, 385, 386, 351, 352, 353; 137/240, 597; 134/169 R, 169 C

[56] References Cited

U.S. PATENT DOCUMENTS

| | | | |
|---|---|---|---|
| 1,993,371 | 3/1935 | Jones | 134/169 C |
| 2,092,257 | 9/1937 | Lewis | 222/372 X |
| 2,178,559 | 11/1939 | Cohen et al. | 137/240 X |
| 2,458,230 | 1/1949 | Warcup | 222/148 X |
| 2,563,385 | 8/1951 | Warcup | 222/148 X |
| 2,645,379 | 7/1953 | Audia | 222/148 X |
| 3,036,741 | 5/1962 | Hilts | 222/148 |
| 3,044,483 | 7/1962 | Wilburn | 137/240 X |
| 3,441,034 | 4/1969 | Burks | 134/169 C X |
| 3,896,972 | 7/1975 | Neidore et al. | 222/136 |
| 3,945,536 | 3/1976 | Doak | 222/148 |
| 4,275,823 | 6/1981 | Credle, Jr. | 222/145 X |
| 4,467,941 | 8/1984 | Du | 222/1 |
| 4,527,585 | 7/1985 | Mirabile | 222/148 X |

FOREIGN PATENT DOCUMENTS

| | | | |
|---|---|---|---|
| 983661 | 2/1976 | Canada | 15/12.9 |
| 53331 | 9/1984 | Canada . | |
| 2462387 | 3/1981 | France | 222/148 |

OTHER PUBLICATIONS

Doak Manifold San. Co., Ltd. Fliers—Letters A–M, 1983.

*Primary Examiner*—Joseph J. Rolla
*Assistant Examiner*—Edward S. Ammeen
*Attorney, Agent, or Firm*—Pahl, Lorusso & Loud

[57] ABSTRACT

This invention provides an apparatus and a method for sanitizing beverage dispensing systems of the type using a pump that draws the beverage from a single port collapsible container which is otherwise air tight. The system consists of a manifold having a main manifold chamber with one input and at least one output, and a secondary manifold chamber having an input and an output. The drink dispensing hoses are attached to the outputs of the main manifold chamber, and either a sanitizing fluid or water is attached to the input of the main manifold chamber. The water may be provided through the secondary manifold chamber. Before connecting to the sanitizing fluid, the main manifold chamber is opened to the atmosphere, and remaining beverage in the dispensing hoses is drawn out by the pumps to the dispensing heads. Afterward, sanitizing fluid and water are drawn through the manifold and the dispensing hoses and heads, sanitizing the system.

7 Claims, 4 Drawing Figures

SYSTEM FOR SANITIZING BEVERAGE DISPENSING SYSTEMS

This invention relates in general to the field of sanitizing beverage dispensing systems, and in particular, to providing a compact system for sanitizing the type of beverage dispensing system that uses a pump that draws the beverage from a single port, collapsible container which is otherwise air tight.

BACKGROUND OF THE INVENTION

Systems for dispensing beverages such as beer, soda, milkshakes and wine, commonly incorporate a beverage or flavor source container, connected through hoses or lines to a dispensing head. For simplicity, the beverage or flavor will be referred to as "beverage," although it will be understood that often, other ingredients, such as carbonated water, are mixed with the beverage before it is served. Ordinarily, the beverage is driven from the source container by pressurized air or carbon dioxide injected into the container. Often, the connecting hoses between the beverage source and the dispensing head are rather long, as when the beverage source containers are kept far away from the dispensing head. Due to the sticky nature of most beverages, and simply for sanitary reasons, it is necessary to clean and sanitize the elements of the beverage dispensing system frequently, including the hoses that connect the beverage source to the dispensing head, and the plumbing in the dispensing head itself.

It should be noted that concerning the art of food and beverage sanitation, the terms "cleansing" and "sanitizing" have distinct meanings. "Cleansing" means to remove particulate matter. "Sanitizing" means to kill microorganisms. In general, cleansing fluids are different from sanitizing fluids. In the case of beverage dispensing systems, however, it is common to provide a combined sanitizing/cleansing fluid. For simplicity, the term "sanitizing" fluid may be used to mean sanitizing/-cleansing, in connection with beverage systems.

Several methods for sanitizing beverage delivery systems exist. The most primitive method is to connect the end of the hose that is normally connected to the beverage source, to a carbon dioxide source and to merely pump the carbon dioxide through, blowing out as much foreign matter as possible. This method does not, however, sanitize the system with any sanitizer.

Another method is to connect each individual hose to a series of tanks of fluid and force pressurized air, water (may be a cleanser), sanitizing fluid, water and again pressurized air through the system to sanitize the hoses and the dispensing head. With a many beverage system, such as a soft drink fountain in a fast food establishment, or in a bar, this process is time consuming and cumbersome. In practice, proprietors often do not sanitize the system as often as necessary. Thus, the syrup or beverage flavor amounts must be adjusted to accomodate for the decrease in flow resultant from contamination and blockage. Commonly, the system departs from the proper flavor balance. Even worse, the system may become unhealthful due to the presence of microorganisms.

Rather than connecting one drink hose at a time to each of the various fluids necessary for the sanitizing process, it is known to connect all of the beverage lines at once to a manifold that permits fluid communication among the drink lines and a common input port. To clean the system, each drink line is attached to an output port of the manifold. Then, the various fluids are connected sequentially to the input port. Each of the fluids, such as water and sanitizing fluid, are contained in pressurizeable containers and are driven through the manifold and hose system by carbon dioxide or some other pressurized gas. Initially, carbon dioxide will be connected to the input port. Thus, carbon dioxide will pass through the input port and into the main chamber of the manifold and then out through each of the drink lines to the fountain head. By opening each dispensing valve at the fountain head, the carbon dioxide drives out the remaining beverage in the line, thereby avoiding waste of the drink. After all of the beverage has been consumed or emptied, a water source may be connected to the manifold input. Sequentially, after the water source, a sanitizing fluid source may be connected, then again the water source, to remove any traces of the sanitizing fluid, and finally a carbon dioxide, or pressurized air source to dry out the hoses. After sanitizing in this manner, the individual drink hoses are reconnected to the drink containers and dispensing of drink may continue.

A method for utilizing a manifold system of this type has been described in Canadian Pat. No. 983,661. U.S. Pat. No. 3,945,536, also describes in general the need for frequent sanitizing of drink dispensing systems and a method for accomplishing this sanitizing involving a specialized nested container housing both water and sanitizing fluid.

It should be noted, that in all of the methods described above, the water and the sanitizing fluid are driven into the manifold, and out through the syrup lines to the dispensing head, by some type of pressure source. Thus, the water source must either be pressurized of its own, or the water be in a container capable of being pressurized by carbon dioxide or another gas. Similarly, the sanitizing fluid and the beverages must also be kept in pressurizeable containers. Pressurizeable containers such as beer kegs, are heavy and typically must be returned to a distributor for return of a deposit.

When the beverage is supplied in pressurized cans, as described above, a certain amount of waste necessarily occurs. This is because it is not possible to pump out all of the drink flavor in the cans with the pressure source. Thus, several ounces of drink flavor per can are wasted. When applied to the high volume of many restaurants and fast food establishments, several ounces wasted per can translates to thousands of dollars very quickly.

In order to overcome the waste and inconvenience of pressurized cans, the drink or flavor is also supplied in a different type of container. With this second type of beverage supply system, the beverage is supplied in collapsible plastic or mylar bags, having only one port. A cardboard box surrounds the bag, to support the bag. The port of the bag is connected to one end of a hose, the other end of which is connected to the fountain head. In order to draw the liquid from the bag to the fountain head, a pump is provided in-line in the hose. The pump draws the beverage from the bag and then pumps it on to the dispensing head. The bag collapes so that virtually no air is entrained in the bag. The pump is a relatively low capacity pump. It is capable of drawing fluid from two separate beverage bags. However, the fluid bags must contain the same type of drink, since the drink passes through the pump. Therefore, in general, each flavored drink requires a separate line and pump.

Because the bag has only one port, the fluid must be drawn from the bag by the pump, rather then being forced from the bag by a pressurized source. Because the bag has only one port, and this port must empty the entire bag, the drink bag must be provided with special fittings and valves. The fitting attached to the bag includes a tube that extends to the bottom of the bag. This tube enables emptying all of the drink flavor from the bag. This system will be referred to as the "bag and box" type system.

As has been explained above, the method of sanitizing according to the prior art, utilizing the manifold, requires that the normal beverage delivery system hoses connected to the beverage source, be attachable to the manifold. Thus to sanitize a bag and box type system, a manifold must be fitted with special fittings and valves capable of mating with those provided on the hoses of the bag and box type system. Further, according to the above described prior art, the various fluids (drink, water, sanitizing fluid, carbon dioxide) are driven through the manifold by pressurized gas. Due to the interposition of the pump in the line, it would be inefficient to drive the fluid through the bag-system lines using pressurized gas since the pump is available and capable of doing the work. The fluid may be drawn from a reservoir into the manifold, out through the special fitting, through the line, through the pump and up to the fountain head.

It is also desireable, to use up the remaining beverage in the lines, which may be substantial depending upon the length of the lines, without drawing any other type of fluid through the lines. To do this, in the case of the bag and box type of dispensing system, it is necessary to open the end of the line behind the beverage, to atmospheric pressure, to permit the pump to draw the beverage from the line and to the dispensing head.

Thus, it is an object of the present invention to provide a system that will facilitate the cleaning of beverage dispensing systems designed to be used with sysetms including collapsible mylar or plastic beverage containing bags. It is a further object of the invention to provide a compact manifold device that will accomplish all of the necessary tasks of sanitizing a system, including the initial consumption of remaining beverage, sanitizing with sanitizing fluid, flushing with water, and drying with compressed gas. It is a further object of the invention to provide a system that permits using disposable containers containing premeasured volumes of sanitizing fluid and thereby eliminating waste.

SUMMARY OF THE INVENTION

According to the present invention, a manifold is provided having special fittings designed to accept the fittings required for the callapsible bag type drink containers. The manifold is configured to permit attachment of a plurality of drink lines, all of which may communicate through a main manifold chamber with a common input port. The manifold also permits venting the commonly communicating chamber of the manifold to atmospheric pressure, either by a dedicated vent valve, or by venting one of the common valves, thereby facilitating discharge of the beverage from the lines before sanitizing. It is also a feature of the present invention, to provide the sanitizing fluid in suitably sized disposable containers similar to the collapsible bag and box drink containers. The sanitizing fluid containers may be premeasured, depending upon the total length of hoses, to be sanitized and the number of dispensing heads. Premeasurement eliminates waste of sanitizing fluid, and minimizes the time required to sanitize the system. Further, the bag and box sanitizing fluid containers are disposable, thereby enhancing the convenience of the system.

DETAILED DESCRIPTION OF THE PREFERRED EMBODIMENT

Figure 1B:
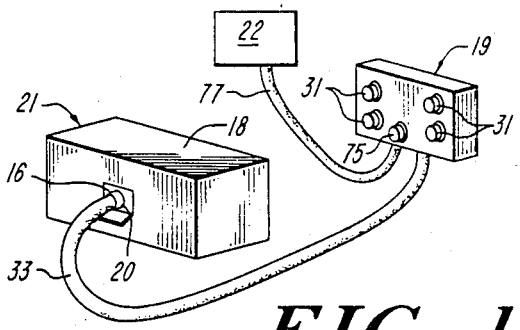
FIG. 1*b* shows a sanitizing manifold attached to a fluid container and a water source.
Figure 1A:
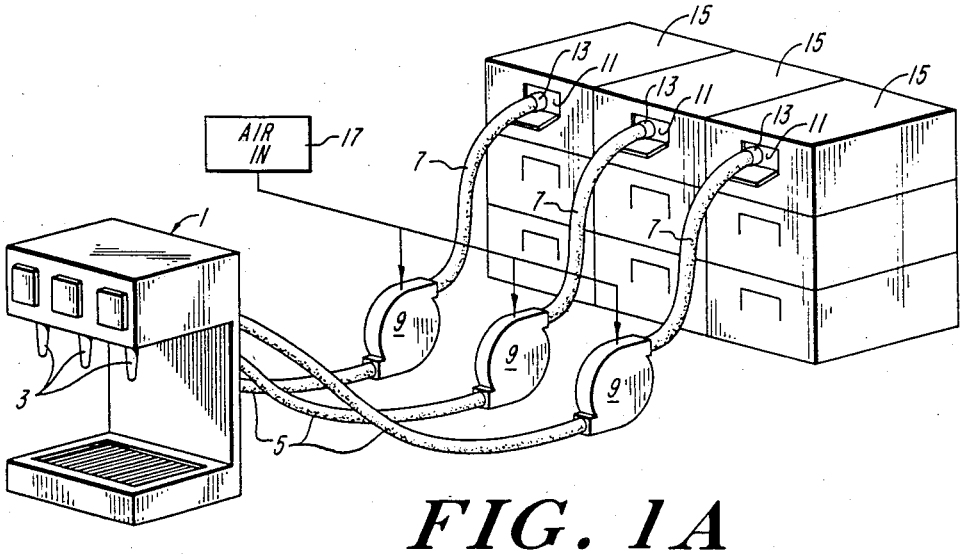
FIG. 1*a* shows a drink delivery system in schematic, including the fountain head, a series of bag and box type drink containers, and pumps and associated hoses.

The present invention may be best understood with reference to the following discussion and the above identified drawings. FIGS. 1*a* and 1*b* show the bag and box type drink delivery system schematically, along with a schematic representation of a manifold according to the present invention. The drink fountain 1 includes a plurality of dispensing heads 3. Each dispensing head is attached to a pump hose 5 that communicates with a bag hose 7 through a pump 9. The bag hoses 7 are connected to collapsible mylar or plastic bags 11 through bag hose couplings 13. Cardboard boxes 15 surround and support collapsible bags 11. the pumps 9 are driven by a compressed air source shown schematically at 17. A manifold 19 is shown schematically along side the boxes. In practice, the manifold would be attached to a wall or other vertical surface. The manifold is shown schematically connected to a container of fluid 21, which fluid might be sanitizing fluid or water. The fluid is contained in a collapsible bag 16 housed in a cardboard box 18, substantially identical in construction to bags 11 and boxes 15. A hose 33 is connected to bag 16 through manifold input fitting 20. A water source 22 is shown schematically, connecting to manifold 19 through hose 77.

Figure 2:
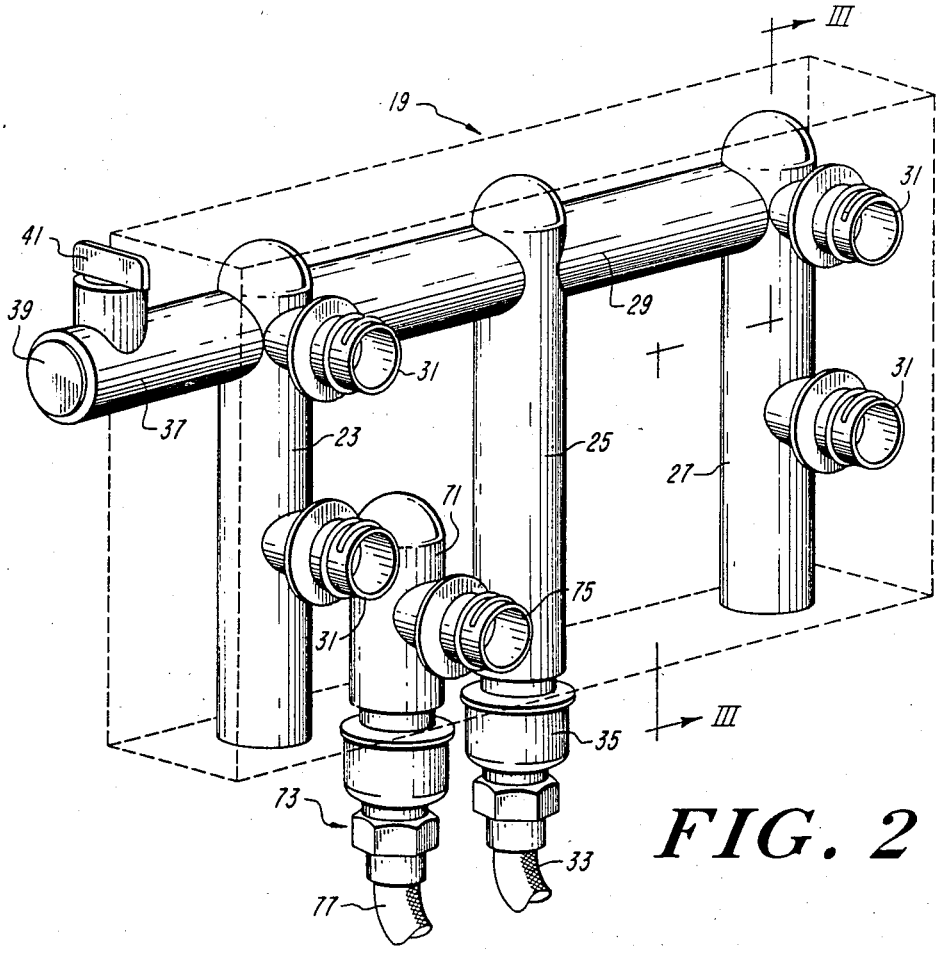
FIG. 2 shows a perspective view of a manifold of the present invention designed to be used with the bag and box type drink dispensing system.

FIG. 2 shows one embodiment of the manifold of the present invention with the outer housing shown only in phantom. This embodiment of the manifold consists of four substantially cyclindrical intersecting chambers 23, 25, 27 and 29 all of which communicate with each other. In the embodiment shown, four manifold fittings 31 also communicate with the common chamber and the outside atmosphere. A hose 33 connects through a fitting 35 to the main chamber of the manifold. This hose may be connected to a sanitizing fluid source, or to a water source, as shown schematically in FIG. 1*b*, or to a pressurized gas source. An extension 37 of chamber 29 terminates in an orifice 39 communicating with the atmosphere. This orifice may be opened or shut by operation of stop cock 41.

Figure 3:
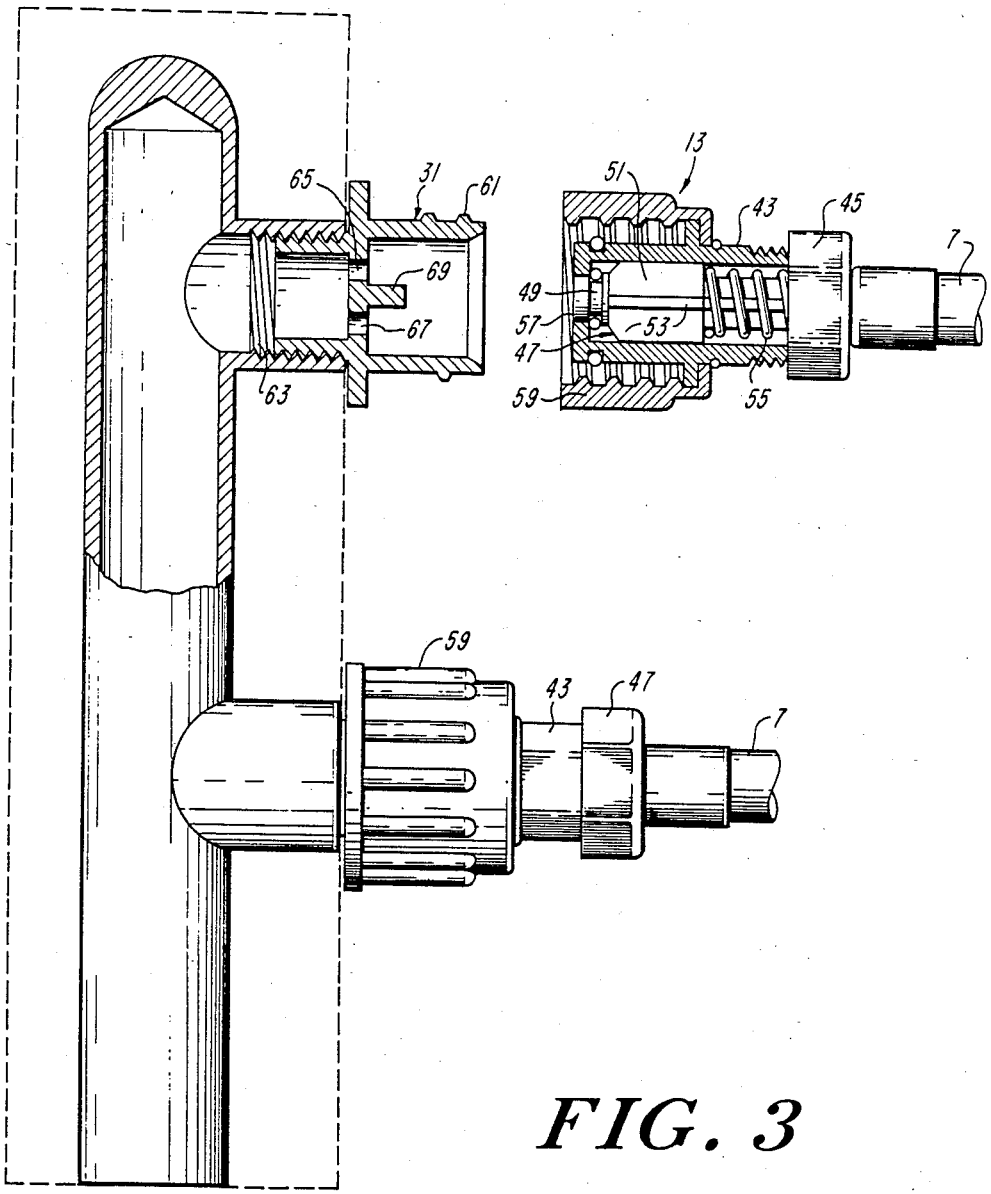
FIG. 3 shows a view in partial cross-section along the section line III—III of FIG. 2.

The cooperation between the manifold and its associated manifold fittings 31, and the bag and box beverage delivery system may best be seen with reference to FIG. 3. FIG. 3 shows a section of the manifold shown in FIG. 2, along the lines III—III as shown in FIG. 2. Additionally shown in FIG. 3, is a pair of bag hose couplings 13, one shown in cross-section and one shown in perspective. The bag hose couplings are connected to the ends of bag hoses 7. The bag hoses are connected, through the pumps, to pump hoses 5 and dispensing heads 3. Bag hose 7 is attached to hose end fitting 43 by the cooperation of external threads on the fitting 43 and a nut 45 which is free to spin at the end of hose 7. Hose end fitting 43 has a hose end and a mating end.

Hose end fitting 43 comprises substantially a hollow cylinder. A plunger 47 having a disk shaped end section 49, and a vaned body portion 51 having a plurality of radially projecting vanes 53, is translatable axially within said hose end fitting 43. A spring 55, captured between a stepped portion of the vaned insert 51 and the hose end face of hose end fitting 43, urges the vaned insert 51 toward the mating end of those end fitting 43, thereby pressing disk portion 49 into orifice 57 in the mating end of hose end fitting 43. A nut 59 is free to spin around fitting 43, but does not translate along the axis of fitting 43.

The above described hose end fitting connects to any one of the manifold fitting 31. The manifold fitting 31 is provided with external threads 61 at one end designed to engage the internal threads of nut 59. Manifold fitting 31 is threaded at its other end into a receptacle 63 in the manifold. The manifold fitting has a web portion 65 that is pierced by holes 67 for fluid passage. At the center of web 65 is a projection 69. When hose end fitting 43 is placed onto manifold fitting 31 and nut 59 is turned, engaging threads 61, the projection 69 is drawn toward the orifice 57 and the disk shape portion 49 of the vaned insert 53. As the nut tightens the connection, the vaned insert is forced away from the orifice 57, permitting passage of fluid therethrough. The fluid passes through the holes 67 and through orifice 57 and then along the length of the vaned insert into bag hose 7.

Returning to FIG. 2, input hose 33 is attached to the main communicating manifold chamber 25 and is terminated by an input fitting 20 identical in its mating structure to the hose end fitting 43, described and illustrated in FIG. 3, although this fitting is not shown.

The manifold is also provided with a secondary chamber 71, which does not communicate with the chambers 23, 25, 27 and 29 described above. This chamber is provided with an input hose fitting assembly 73 and an output fitting 75, which is identical in its mating structure to the manifold fitting 31 described above. The purpose of the secondary chamber will be evident from the discussion of the operation of the system below.

The system functions as follows. The pumps 9 draw the last bit of beverage from the bags 11. The bag hose couplings 13 are disconnected from the bags 11 and connected to manifold fittings 31 on the manifold. Stop cock 41 is opened, so that orifice 39 communicates with the atmosphere. Input hose 33 is not connected to any external fluid source at this time. The pumps are able to continue to draw the beverage from the bag hoses 7 and to pump the beverage through the pump hoses 5, if the fountain heads 3 are open. Thus, virtually every last drop of beverage can be used.

As can be seen from FIG. 3, when the fittings 13 are engaged with manifold fittings 31, projection 69 has depressed the vaned shaped insert 51 so that fluid may pass therethrough. Next, the input fitting 20 at the end of hose 33 is connected to secondary chamber output fittings 75 and chamber 71. Hose 77 is permanently connected between the secondary chamber and a source of water. Again, the dispensing heads 3 are opened and the pumps 9 are energized. The pumps draw water through hose 77, chamber 71, fitting 75, hose 33 and then into the main chamber of the manifold. Thus, water fills the entire multi-chamber system, and then passes through each of the bag hoses 7 to clean the bag hoses 7 and pump hoses 5.

After the entire system has been flushed with water, a sanitizing fluid is sent through. The hose 33 is attached through fitting 20 to a sanitizing container 16 and sanitizing fluid is drawn through the system as the water was drawn through. The sanitizing fluid may be dispsensed from a bag 16 and box 18 system identical to the beverage container system. This arrangement is convenient because the sanitizing fluid can be premixed to an appropriate amount for the desired size of the system. Further, a container containing the sanitizing fluid may be a disposable cardboard box, rather than a heavy pressurizeable container.

The manifold block 19 may be made of plastic or metal. It has been found that plastic provides the best results, being lightweight and easily machinable. A polycarbonate plastic is also sterilizable at high temperature. It is a material approved by the U.S. Food and Drug Administration for food and beverage handling.

The foregoing description should be taken as illustrative, and should not be considered to be limiting in any sense. Modifications and adaptations within the spirit of the invention will be evident to one skilled in the art.

What is claimed is:

1. A system for sanitizing beverage dispensing systems that utilize collapsible bag and box type beverage containers, said dispensing system including a collapsible bag, having one port, supported by a box, said port being attached to a bag hose through a hose end fitting, said bag hose being attached to a pump for drawing liquid from said bag, and said pump being connected to a dispensing head through a pump hose, said sanitizing system comprising:

(a) a manifold block including a main manifold chamber having one input and at least one output, and a vented portion, said at least one output having attached thereto a manifold fitting capable of releasably sealably mating with said hose end fitting of said bag hose;

(b) said input to said manifold chamber being connected to an input hose having, at its distant end, an input fitting of substantially identical sealing structure as said hose end fitting of said bag hose;

(c) said manifold block also including at least one secondary chamber having an input and an output, said input being attachable through a secondary chamber input hose to a fluid source, and said output being fitted with a fitting of substantially identical sealing structure as said manifold fitting, said output fitting being capable of mating in a sealable relationship with said input fitting at the distant end of said input hose; and (d) a cleaning fluid container connected through said input fitting to said distant end of said input hose such that cleaning fluid may be drawn through said input hose, into said main manifold chamber, out of said at least one output port, through a bag hose attached to said at least one output port, through said pump, said pump hose and said dispensing head.

2. The sanitizing system of claim 1 wherein said cleaning fluid container is a collapsible single port plastic bag.

3. The sanitizing system of claim 1, wherein said manifold fitting comprises:

(a) a substantially hollow cylinder having a manifold end and a hose end, said manifold end including means for securing said fitting to said manifold;

(b) said fitting end including an outer cylindrical surface, having threads sized and shaped to mate with threads included on said hose end fitting; and (c) a central web, occupying substantially a circular plane perpendicular to the central axis of said manifold fitting, said web having at its center a projection projecting toward the hose end of said manifold fitting, and apertures circumscribing said central projection, sized to permit fluid to flow therethrough.

4. The sanitizing system of claim 3 where said ventable portion of said main manifold chamber comprises a stop cock.

5. The sanitizing system of claim 4, wherein said main manifold is formed from plastic.

6. A method for sanitizing beverage dispensing systems that utilize collapsible bag and box type beverage containers, said dispensing system including a collapsible bag, having one port, supported by a box, said port being attached to a bag hose through a hose end fitting, said bag hose being attached to a pump for drawing liquid from said bag, and said pump being connected to a dispensing head through a pump hose, said sanitizing method comprising:

(a) providing a manifold block including:

(i) a main manifold chamber having one input and at least one output, and a vented portion, said at least one output having attached thereto a manifold fitting capable of releasably sealably mating with said hose end fitting of said bag hose and said input to said main manifold chamber being connected to an input hose having, at its distant end, an input fitting of substantially identical sealing structures as said hose end fitting of said bag hose; and (ii) at least one secondary chamber having an input and an output, said input being attachable through a secondary chamber input hose to a water source, and said output being fitted with a fitting of substantially identical sealing structure as said manifold fitting, said output fitting being capable of mating in a sealable relationship with said input fitting at the distant end of said input hose; and (b) disconnecting said bag hose from said collapsible bag and connecting said bag hose to said manifold fitting of said at least one output port of said main manifold chamber;

(c) opening said vent in said main manifold chamber;

(d) energizing said pump and drawing any remaining beverage through said bag hose and out through said dispensing head;

(e) attaching said distant end of said input hose to said output of said secondary chamber;

(f) closing said vent in said main manifold chamber;

(g) drawing water from said water source, through said secondary chamber, through said manifold input hose, through said main manifold chamber, out through said at least one output port, through said bag hose, pump, and pump hose and out through said dispensing head;

(h) disconnecting said distant end of said manifold input hose from said secondary chamber output port and connecting said distant hose end to a source of sanitizing fluid;

(i) drawing said sanitizing fluid through said system in the same manner as said water was drawn through said system;

(j) disconnecting said distant end of said input hose from said sanitizing fluid and reconnecting said distant end of said input hose to said output port of said secondary chamber;

(k) drawing water through said system in said same manner; and (l) connecting said bag hoses to a beverage source.

7. The method of sanitizing a beverage delivery system claimed in claim 6 comprising the further step of providing said sanitizing fluid in a single port collapsible bag housed in a cardboard container.

* * * * *